US006788904B2

(12) United States Patent
York

(10) Patent No.: US 6,788,904 B2
(45) Date of Patent: Sep. 7, 2004

(54) CLIMATE CONTROL SYSTEM FOR DEVELOPER MATERIAL IN A DEVELOPER HOUSING

(75) Inventor: James R. York, Webster, NY (US)

(73) Assignee: Xerox Corporation, Stamford, CT (US)

( * ) Notice: Subject to any disclaimer, the term of this patent is extended or adjusted under 35 U.S.C. 154(b) by 35 days.

(21) Appl. No.: 10/252,896

(22) Filed: Sep. 23, 2002

(65) Prior Publication Data

US 2004/0057746 A1 Mar. 25, 2004

(51) Int. Cl.[7] ..... G03G 15/00; G03G 15/08

(52) U.S. Cl. ..... 399/44; 399/53; 399/94

(58) Field of Search ..... 399/44, 53, 91, 399/94, 97, 222, 252

(56) References Cited

U.S. PATENT DOCUMENTS

| | | | | |
|---|---|---|---|---|
| 4,027,621 A | * | 6/1977 | Kane et al. | 399/97 X |
| 5,701,550 A | * | 12/1997 | Lofftus et al. | 399/44 |
| 5,862,433 A | * | 1/1999 | Regelsberger et al. | 399/44 |
| 5,890,033 A | * | 3/1999 | Parker | 399/94 |
| 5,937,226 A | * | 8/1999 | Kim | 399/44 |
| 6,400,915 B2 | * | 6/2002 | Nukada | 399/94 |

* cited by examiner

*Primary Examiner*—William J. Royer
(74) *Attorney, Agent, or Firm*—Lloyd F. Bean, II

(57) ABSTRACT

An apparatus for developing a latent image recorded on a movable imaging surface, including a reservoir for storing a supply of developer material including toner particles; a donor member being arranged to receive toner particles from the reservoir and to deliver toner particles to the imaging surface at locations spaced apart from each other in the direction of movement of the imaging surface thereby to develop the latent image thereon; and a climate system, associated with the reservoir, for maintaining the supply of developer material at a predefined temperature.

16 Claims, 2 Drawing Sheets

CLIMATE CONTROL SYSTEM FOR DEVELOPER MATERIAL IN A DEVELOPER HOUSING

This invention relates to an apparatus for maintaining the environment of developer material in a developer housing at a predefined set point.

Generally, the process of electrophotographic printing includes charging a photoconductive member to a substantially uniform potential to sensitize the photoconductive surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto a photoreceptor prior to the transfer of the composite toner powder image onto a substrate. While the IOI process provides certain benefits, such as a compact architecture, there are several challenges to its successful implementation. For instance, the viability of printing system concepts, such as IOI processing, require development systems that do not interact with a previously toned image. Since several known development systems, such as conventional magnetic brush development and jumping single-component development, interact with the image on a receiver, a previously toned image will be scavenged by subsequent development if interacting development systems are used. Thus, for the IOI process, there is a need for scavengeless or noninteractive development systems.

Hybrid scavengeless development technology develops toner via a conventional magnetic brush onto the surface of a donor roll and a plurality of electrode wires are closely spaced from the toned donor roll in a development zone. An AC voltage is applied to the wires to generate a toner cloud in the development zone. The donor roll generally consists of a conductive core covered with a thin (50–200 .mu.m) partially conductive layer. The donor roll is held at an electrical potential difference relative to the conductive core to produce the field necessary for toner development. The toner layer on the donor roll is then disturbed by electric fields from a wire or set of wires to produce and sustain an agitated cloud of toner particles. Typical AC voltages of the wires relative to the donor roll are 700–900 Vpp at frequencies of 5–15 kHz. These AC signals are often square waves, rather than pure sinusoidal waves. Toner from the cloud is then developed onto a nearby photoreceptor by fields created by a latent image.

A problem with developer systems is that when the temperature of a material is not in control results in increase contamination; donor roll filming, particles forming on electrode wires, material migration through a xerographic. cavity, toner spitting, low image density, and poor/changing material transfer characteristics.

There is provided an apparatus for developing a latent image recorded on a movable imaging surface, including a reservoir for storing a supply of developer material including toner particles; a donor member being arranged to receive toner particles from said reservoir and to deliver toner particles to the imaging surface at locations spaced apart from each other in the direction of movement of the imaging surface thereby to develop the latent image thereon; and a climate system, associated with said reservoir, for maintaining said supply of developer material at a predefined temperature.

There is also provided an electrostatic printing machine having an apparatus for developing a latent image recorded on a movable imaging, surface, including a reservoir for storing a supply of developer material including toner particles; a donor member being arranged to receive toner particles from said reservoir and to deliver toner particles to the imaging surface at locations spaced apart from each other in the direction of movement of the imaging surface thereby to develop the latent image thereon; and a climate system, associated with said reservoir, for maintaining said supply of developer material at a predefined temperature.

There is also provided a method for maintaining the environment of developer material in a developer housing at a predefined set point comprising: sensing the temperature of said supply of developer material; and selectively activating and de-activating a heating element or a cooling element based on the temperature sensed.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 1:
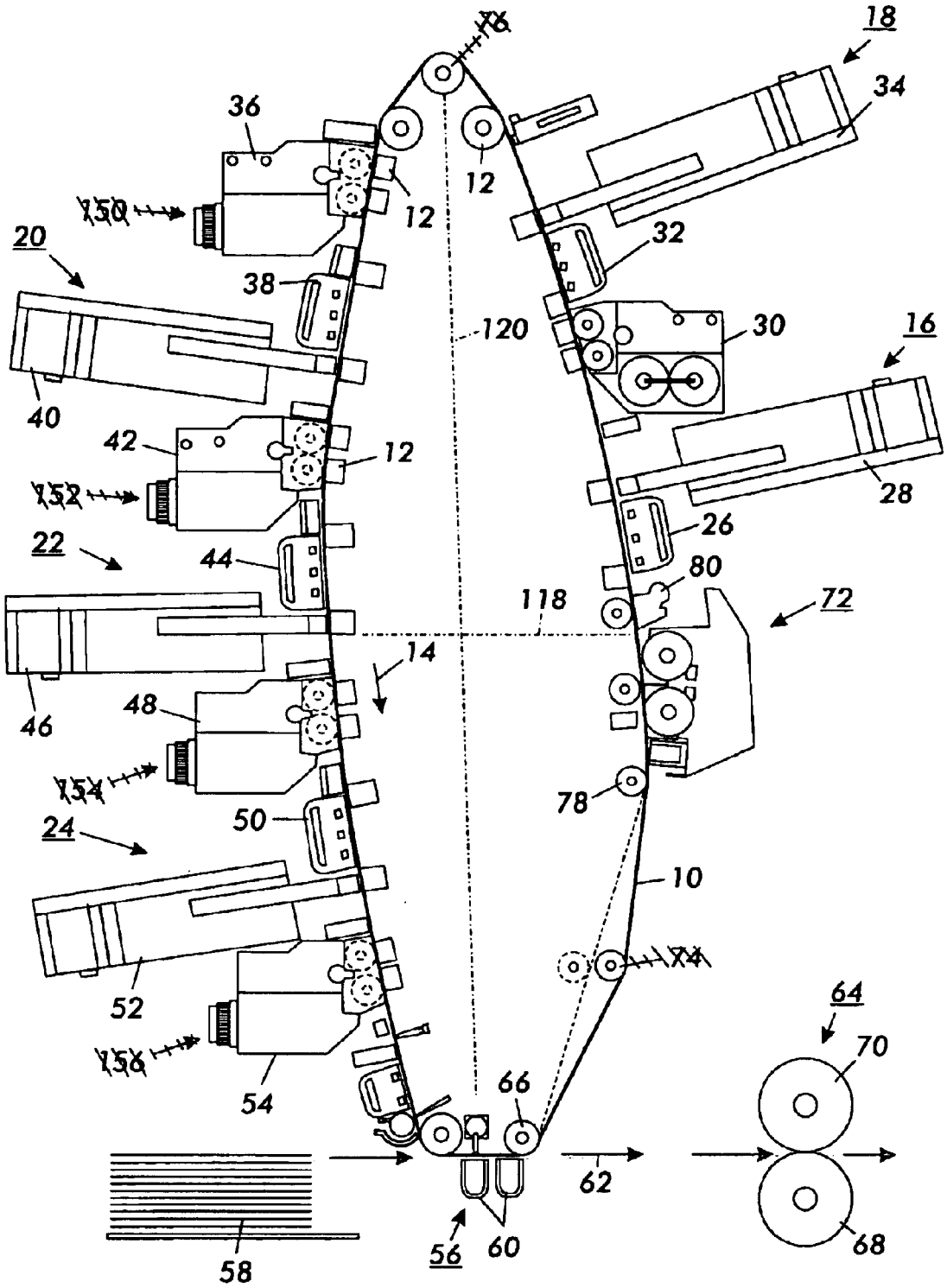
FIG. 1 is an electrostatic printing machine incorporating the present invention.

Referring now to the drawings, there is shown a single pass multi-color printing machine. This printing machine employs a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 118, 120 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished-sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Figure 2:
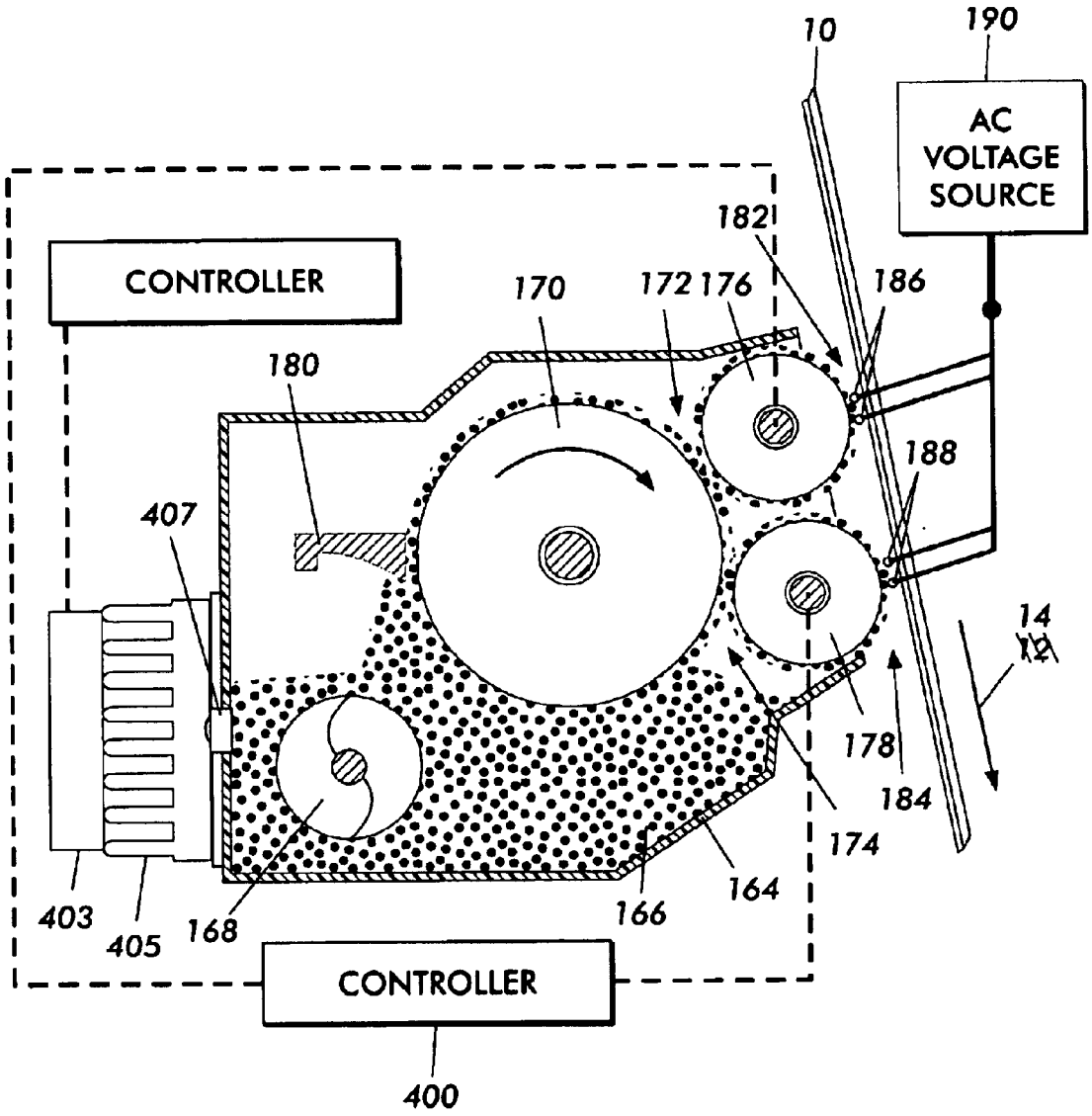
FIG. 2 is a developer unit incorporating the present invention.

Referring now to FIG. 2, there are shown the details of a development apparatus. The apparatus comprises a reservoir developer housing 164 containing developer material 166. The developer material 166 is of the two component type, that is it comprises carrier granules and toner particles. The reservoir 164 includes augers 168, which are rotatably-mounted in the reservoir chamber. The augers 168 serve to transport and to agitate the developer material 166 within the reservoir 164 and encourage the toner particles to adhere triboelectrically to the carrier granules. A magnetic brush roll 170 transports developer material 166 from the reservoir 164 to loading nips 172, 174 of two donor rolls or members 176, 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material 166 are magnetic and, as the tubular housing of the magnetic brush roll 170 rotates, the granules (with toner particles adhering triboelectrically thereto) are attracted to the magnetic brush roll 170 and are conveyed to the donor roll loading nips 172, 174. A metering blade 180 removes excess developer material 166 from the magnetic brush roll 170 and ensures an even depth of coverage with developer material 166 before arrival at the first donor roll loading nip 172. At each of the donor roll loading nips 172, 174, toner particles are transferred from the magnetic brush roll 170 to the respective donor roll 176, 178.

Each donor roll 176, 178 transports the toner to a respective development zone 182, 184 through which the photoconductive belt 10 passes. Transfer of toner from the magnetic brush roll 170 to the donor rolls 176, 178 can be encouraged by, for example, the application of a suitable D.C. electrical bias to the magnetic brush roll 170 and/or donor rolls 176, 178. The D.C. bias (for example, approximately 100 v applied to the magnetic brush roll 170) establishes an electrostatic field between the magnetic brush roll 170 and donor rolls 176, 178, which causes toner particles to be attracted to the donor rolls 176, 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176, 178 can be adjusted, for example by: applying different bias voltages to the donor rolls 176, 178; adjusting the magnetic brush roll to donor roll spacing; adjusting the strength and shape of the magnetic field at the loading nips and/or adjusting the speeds of the donor rolls 176, 178.

At each of the development zones 182, 184, toner is transferred from the respective donor rolls 176, 178 to the latent image on the photoconductive belt 10 to form a toner powder image on the latter. Various methods of achieving an adequate transfer of toner from a donor roll to a photoconductive surface are known and any of those may be employed at the development zones 182, 184.

In FIG. 2, each of the development zones 182, 184 is shown as having the form i.e. electrode wires 186, 188 are disposed in the space between each donor roll 176, 178 and photoconductive belt 10. FIG. 2 shows, for each donor roll 176, 178 a respective pair of electrode wires 186, 188 extending in a direction substantially parallel to the longitudinal axis of the donor rolls 176, 178. The electrode wires 186, 188 are made from thin (i.e. 50 to 100 mu. diameter) tungsten wires which are closely spaced from the respective donor rolls 176, 178. The distance between each electrode wires 186, 188 and the respective donor rolls 176, 178 is within the range from about 10 mu. to about 40 mu. (typically approximately 25 .mu.) or the thickness of the toner layer on the donor rolls 176, 178. The electrode wires 186,188 are self-spaced from the donor rolls 176, 178 by the thickness of the toner on the donor rolls 176, 178. To this end the extremities of the electrode wires 186, 188 are supported by the tops of end bearing blocks that also support the donor rolls 176, 178 for rotation. The electrode wires 186, 188 extremities are attached so that they are slightly below a tangent to the surface, including the toner layer, of the donor rolls 176, 178. An alternating electrical bias is applied to the electrode wires 186, 188 by an AC voltage source 190.

The applied AC establishes an alternating electrostatic field between each pair of electrode wires 186, 188 and the respective donor rolls 176, 178, which is effective in detaching toner from the surface of the donor rolls 176, 178 and forming a toner cloud about the electrode wires 186, 188, the height of the cloud being such as not to be substantially in contact with the photoconductive belt 10. The magnitude of the AC voltage is relatively low, for example in the order of 200 to 500 volts peak a frequency ranging from about 3 kHz to about 10 kHz. A DC bias supply (not shown) applied to each donor roll 176, 178 establishes electrostatic fields between the photoconductive belt 10 and donor rolls 176, 178 for attracting the detached toner particles from the clouds surrounding the electrode wires 186, 188 to the latent image recorded on the photoconductive surface of the photoconductive belt 10. At a spacing ranging from about 10 .mu. to about 40 .mu. between the electrode wires 186, 188 and donor rolls 176, 178, an applied voltage of 200 to 500 volts produces a relatively large electrostatic field within risk of air breakdown.

After development, toner may be stripped from the donor rolls 176, 178 by respective cleaning blades (not shown) so that magnetic brush roll 170 meters fresh toner to clean donor rolls 176, 178. As successive electrostatic latent images are developed, the toner particles within the developer material 166 are depleted. A toner dispenser (not shown) stores a supply of toner particles. The toner dispenser is in communication with reservoir 164 and, as the concentration of toner particles in the developer material 166 is decreased, fresh toner particles are furnished to the developer material 166 in the reservoir 164. The augers 168 in the reservoir chamber mix the fresh toner particles with the remaining developer material 166 so that the resultant developer material 166 therein is substantially uniform with the concentration of toner particles being optimized. In this way, a substantially constant amount of toner particles is in the reservoir 164 with the toner particles having a constant charge.

In the arrangement shown in FIG. 2, the donor rolls 176, 178 and the magnetic brush roll 170 can be rotated either "with" or "against" the direction of motion of the photoconductive belt 10. The two-component developer 166 used in the apparatus of FIG. 2 may be of any suitable type. However, the use of an electrically conductive developer is preferred because it eliminates the possibility of charge build-up within the developer material 166 on the magnetic brush roll 170 which, in turn, could adversely affect development at the second donor roll 178. By way of example, the carrier granules of the developer material 166 may include a ferromagnetic core having a thin layer of magnetite overcoated with a non-continuous layer of resinous material. The toner particles may be made from a resinous material, such as a vinyl polymer, mixed with a coloring material, such as chromogen black. The developer material 166 may comprise from about 95% to about 99% by weight of carrier and from 5% to about 1% by weight of toner.

The present invention includes a climate system, associated with the reservoir 164, for maintaining the supply of developer material 166 at a predefined temperature, the climate system includes a heating element 405 and a cooling element 403. Preferably heating element 405 and a cooling element 403 includes a TEC (Thermal Electric Cooler, also known as a thermal pile). The climate system further includes a sensor 407 for sensing the temperature of the supply of developer material 166. The climate system further includes a controller 400 in communication with the heating element 405, the cooling element 403, and the sensor 407. The controller 400 selectively activating and de-activating the heating element 405 and/or the cooling element 403, based on the temperature sensed by the sensor 407. The heating element 405 and the cooling element 403 is preferably heat sink to an outer portion of the reservoir 164.

Applicants have found that developer material stability, for optimum performance, is based on several variables. Among these variables are relative humidity and temperature. The present invention centers primarily on temperature control. Applicants have found that the present invention provides a stable and repeatable development range for the developer material in printing machines, preferably a nominal temperature set point is defined plus and minus five degrees. Many factors affect this set point. Some include the environmental control unit that maintains an internal machine temperature that is less than what is optimum and material friction, internal to a running developer housing, which drives the temperature higher. The simplicity of using a TEC for a temperature control source is that it can provide an efficient warming source to maintain an optimum standby temperature and a cooling source for materials in a developer run mode. In addition, controlling the temperature set point by external means provide an opportunity to effect the relative humidity of the material and it stability.

The TEC is an efficient and reliable way to provide a bi-directional thermal source. When a direct current is applied to this device one side of the wafer heats and the other side cools. When the current is reversed, the heating and cooling function also reverses on the TEC wafer. The TEC is a heat pump that improves in efficiency as the temperature differential increases on either side of the device. In this application, the TEC assembly is mounted to the developer housing substrate. Since the developer housing and its material constitutes a large mass a heat sink and multiple fans are used to compensate for balancing the other side of the TEC, thus improving its thermal differential and efficiency.

The initial control system utilizes a simple thermostat and DPDT relay. The thermostat was designed to change state at the optimum thermal set point. When the thermostat is below its set point, the TEC provides heat to warm the developer material. When the thermostat detects a temperature above its set point it reverses the current through the TEC, utilizing the relay, causing it to cool the developer material. The control range of this basic system, of plus and minus three degrees, has an improved tolerance of what is required by the developer material. The issued control board utilizes PWM (Pulse Width Modulation), a PID (Proportional Integral Differential) based closed loop control algorithm and multiple temperature thermistor inputs per housing. In addition, inputs were provided to interface to humidity sensors and several output drivers are available to control external devices. A SCB communication interface is enabled to provide data feedback to the primary print engine controller and to allow modification to preset temperature control points for each developer housing.

It is, therefore, apparent that there has been provided in accordance with the present invention which fully satisfies the aims and advantages hereinbefore set forth. While this invention has been described in conjunction with a specific embodiment thereof, it is evident that many alternatives, modification and variations will be apparent to those skilled in the art. Accordingly, it is intended to embrace all such alternatives, modifications and variations that fall within the spirit and broad scope of the appended claims.

I claim:

1. An apparatus for developing a latent image recorded on a movable imaging surface, including:

a reservoir for storing a supply of developer material including toner particles;

a donor member being arranged to receive toner particles from said reservoir and to deliver toner particles to the imaging surface at locations spaced apart from each other in the direction of movement of the imaging surface thereby to develop the latent image thereon; and a climate system, associated with said reservoir, for maintaining said supply of developer material at a predefined temperature, said climate system includes a heating element and a cooling element.

2. The apparatus of claim 1, wherein said climate system further includes a sensor for sensing the temperature of said supply of developer material.

3. The apparatus of claim 2, wherein said climate system further includes a controller in communication with said heating element, said cooling element and said sensor, said controller selectively activating and de-activating said heating element and said cooling element based on the temperature sensed by said sensor.

4. The apparatus of claim 1, wherein said heating element and said cooling element is heat sink to an outer portion of said reservoir.

5. The apparatus of claim 1, wherein said heating element and said cooling element is a TEC.

6. An electrostatic printing machine having an apparatus for developing a latent image recorded on a movable imaging surface, including:

a reservoir for storing a supply of developer material including toner particles;

a donor member being arranged to receive toner particles from said reservoir and to deliver toner particles to the imaging surface at locations spaced apart from each other in the direction of movement of the imaging surface thereby to develop the latent image thereon; and a climate system, associated with said reservoir, for maintaining said supply of developer material at a predefined temperature, said climate system includes a heating element and a cooling element.

7. The apparatus of claim 6, wherein said climate system further includes a sensor for sensing the temperature of said supply of developer material.

8. The apparatus of claim 7, wherein said climate system further includes a controller in communication with said heating element, said cooling element and said sensor, said controller selectively activating and de-activating said heating element and said cooling element based on the temperature sensed by said sensor.

9. The apparatus of claim 6, wherein said heating element and said cooling element is heat sink to an outer portion of said reservoir.

10. The apparatus of claim 6, wherein said heating element and said cooling element is a TEC.

11. An apparatus for a developer comprising:

a reservoir for storing a supply of developer material; and a climate system, associated with said reservoir, for maintaining said supply of developer material at a predefined temperature;

wherein said climate system includes a heating element and a cooling element.

12. The apparatus of claim 11, wherein said climate system further includes a sensor for sensing the temperature of said supply of developer material.

13. The apparatus of claim 12, wherein said climate system further includes a controller in communication with said heating element, said cooling element and said sensor, said controller selectively activating and de-activating said heating element and said cooling element based on the temperature sensed by said sensor.

14. The apparatus of claim 11, wherein said heating element and said cooling element is heat sink to an outer portion of said reservoir.

15. The apparatus of claim 11, wherein said heating element and said cooling element is a TEC.

16. A method for maintaining the environment of developer material in a developer housing at a predefined set point comprising:

sensing the temperature of said developer material;

providing a climate system that includes a heating element and a cooling element and selectively activating and de-activating the heating element or the cooling element based on the temperature sensed.

* * * * *